US005676582A

United States Patent [19]

Lin

[11] Patent Number: 5,676,582

[45] Date of Patent: Oct. 14, 1997

[54] ROLLING TOY

[76] Inventor: Kuo Jung Lin, No. 100, Lane 175, Cheng Kung Road, Tainan, Taiwan

[21] Appl. No.: 661,752

[22] Filed: Jun. 11, 1996

[30] Foreign Application Priority Data

Feb. 14, 1996 [CN] China ..... 96203097.X

[51] Int. Cl.[6] ..... A63H 33/26

[52] U.S. Cl. ..... 446/130; 446/136; 446/397; 446/458

[58] Field of Search ..... 446/130, 135, 446/136, 397, 297, 458, 303, 269, 270, 279, 288

[56] References Cited

U.S. PATENT DOCUMENTS 2,452,939 11/1948 La Forge ..... 446/135
2,505,626 4/1950 Palmer ..... 446/130
4,726,800 2/1988 Kobayashi ..... 446/458
4,993,983 2/1991 Kurita et al. ..... 446/130 X

*Primary Examiner*—Mickey Yu
*Attorney, Agent, or Firm*—Bacon & Thomas

[57] ABSTRACT

A rolling toy includes a sphere body composed of two parts between which a axle is connected, a frame disposed in the sphere body and having a motor disposed thereto which is mechanically connected to a gear assembly, an end gear of the gear assembly fixedly mounted to the axle, a magnetic switch disposed to the frame and including a switch element and a first magnetic element, a weight disposed to the frame and located opposite to the first magnetic element, a second magnetic element magnetically adhered to an outer surface of the sphere body and magnetically lifting the first magnetic element so as to actuate the magnetic switch to let the gear assembly be operated such that when the sphere is rolled, the second magnetic element will always be magnetically adhered to an upper position of the rolling sphere body.

5 Claims, 8 Drawing Sheets

ROLLING TOY

BACKGROUND OF THE INVENTION

1. Field of the Invention

The present invention relates to a rolling toy and more particularly, to a rolling toy having a motor disposed therein which is connected to an axle of the toy and actuated by a magnetic switch, the rolling toy having a weight disposed therein such that a magnetic element is magnetically adhered on the toy and actuates the magnetic switch so as to maintain the magnetic element on the toy when the toy rolls.

2. Brief Description of the Prior Art

A known rolling toy includes a sphere body in which a motor is disposed and a reduction gear assembly is connected to the motor, the gear assembly including a gear fixedly connected to an axle of the sphere body and a weight being disposed in the sphere body. When the motor is actuated, the reduction gear assembly is operated and the gear mentioned above is rotated with the axle of the sphere body. However, a switch of the motor is disposed in the sphere body such that every time when the rolling toy is operated, a user must disassemble the sphere into two parts to operate the switch and then reassemble the sphere again, thus reducing interest to play the toy, especially for a child.

The present invention intends to provide an improved rolling toy which has a magnetic switch disposed therein and an element can be magnetically adhered to the sphere so as to actuate the switch such that the above-mentioned problems are mitigated and/or obviated.

SUMMARY OF THE INVENTION

The present invention provides a rolling toy which includes a rolling body composed of two parts, an axle connected between a respective inner surface of the two parts. A frame is fixedly disposed to one of the two parts and has a motor disposed thereto which is mechanically connected to a gear assembly which has an end fixedly mounted to the axle of the rolling body.

A magnetic switch is provided on the frame and includes a switch element and a first magnetic element, the first magnetic element supported by the frame and having a rod extending therefrom which removably extends through the frame and the switch element having at least one actuating plate extending therefrom toward the first magnetic element.

A weight is provided on the frame and is located in a position opposite to that of the first magnetic element. The second magnetic element is disposed at an outer surface of the rolling element to magnetically lift the first magnetic element to contact the actuating plate and actuate the switch element such that when the motor and the gear assembly are actuated, the second magnetic element is always magnetically adhered to an upper position of the rolling body.

It is an object of the present invention to provide a rolling toy which is actuated by disposing a second magnetic element onto the rolling body.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
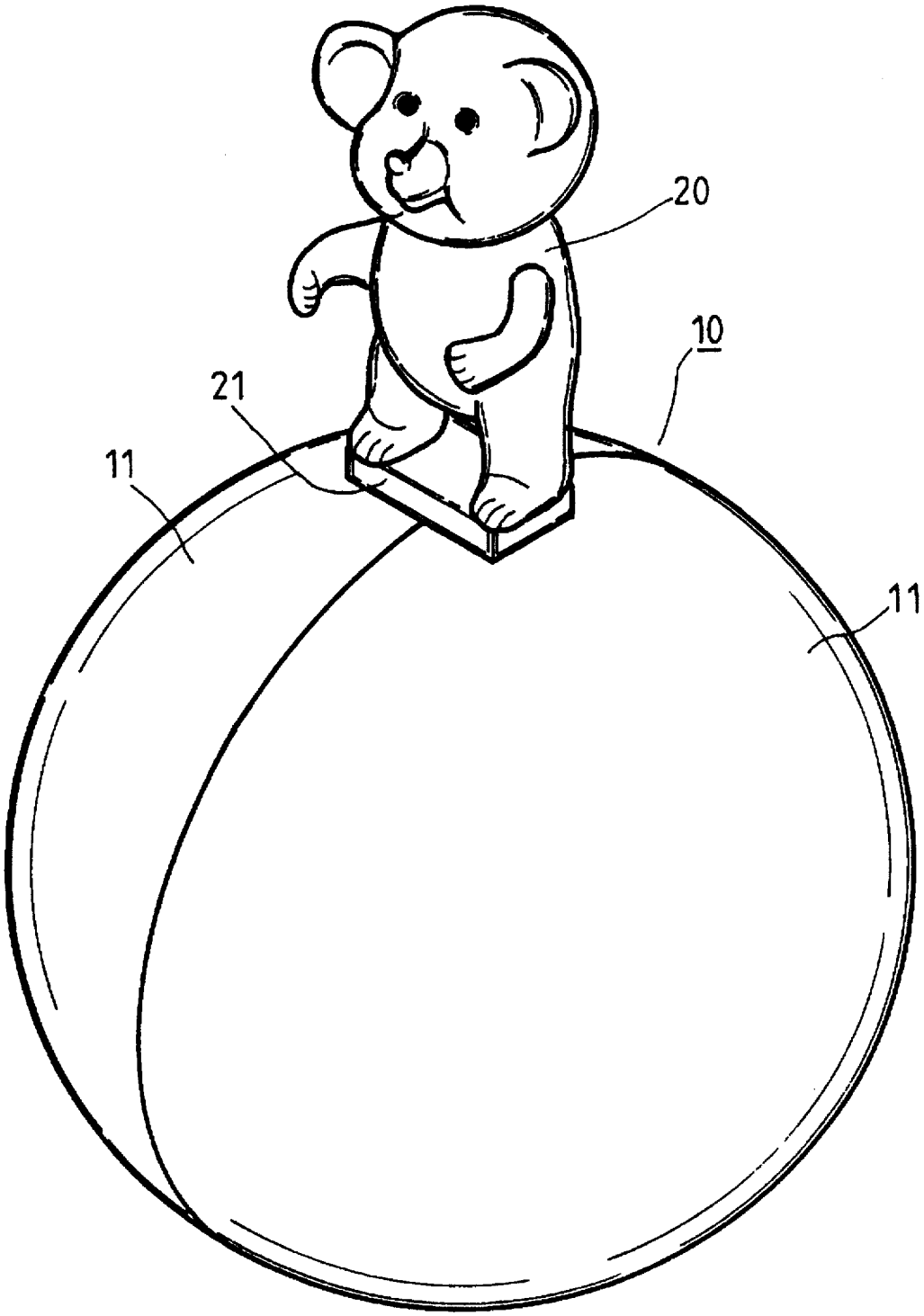
FIG. 1 is a perspective view of a rolling toy in accordance with the present invention.
Figure 2:
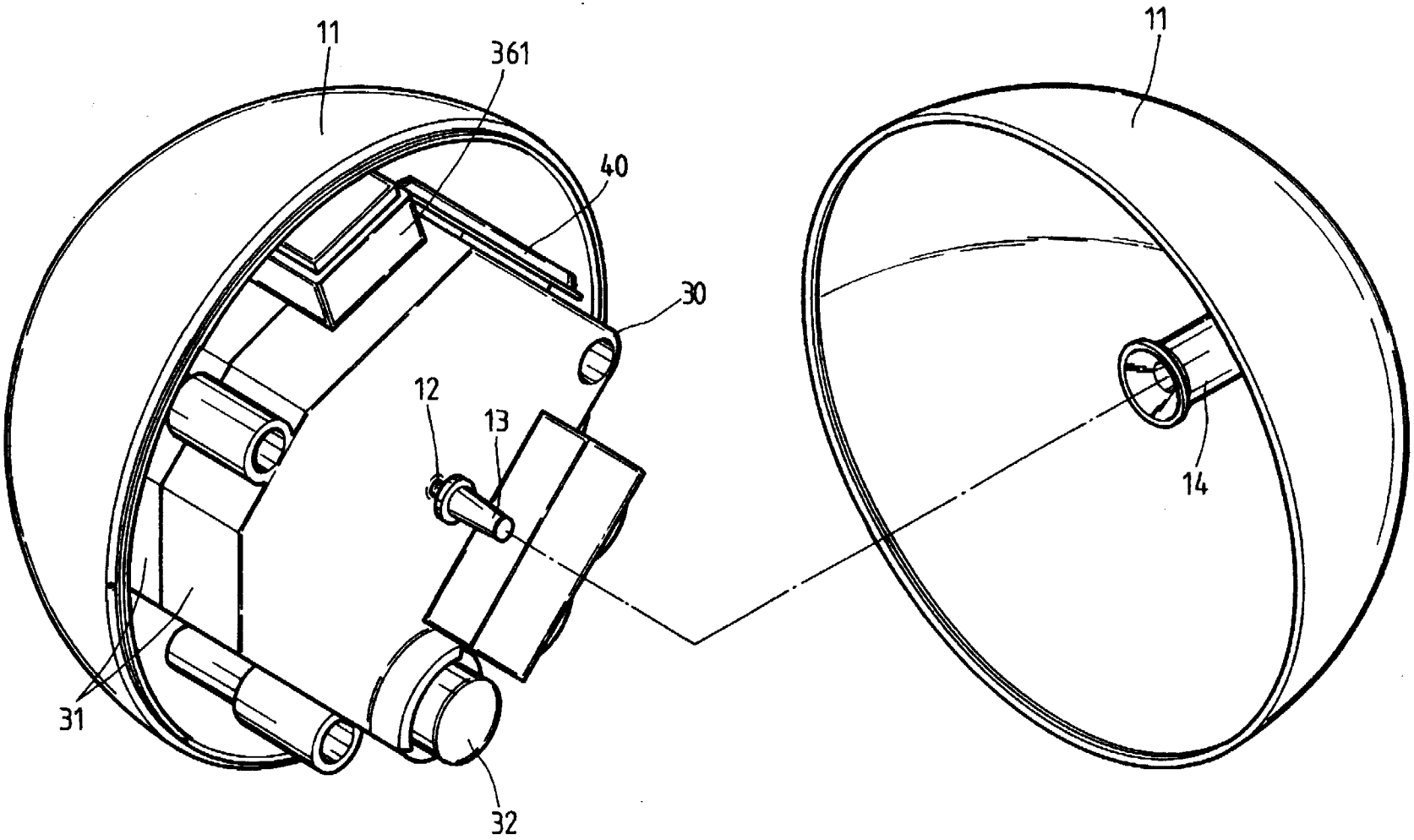
FIG. 2 is an exploded view of the rolling toy in accordance with the present invention.
Figure 3:
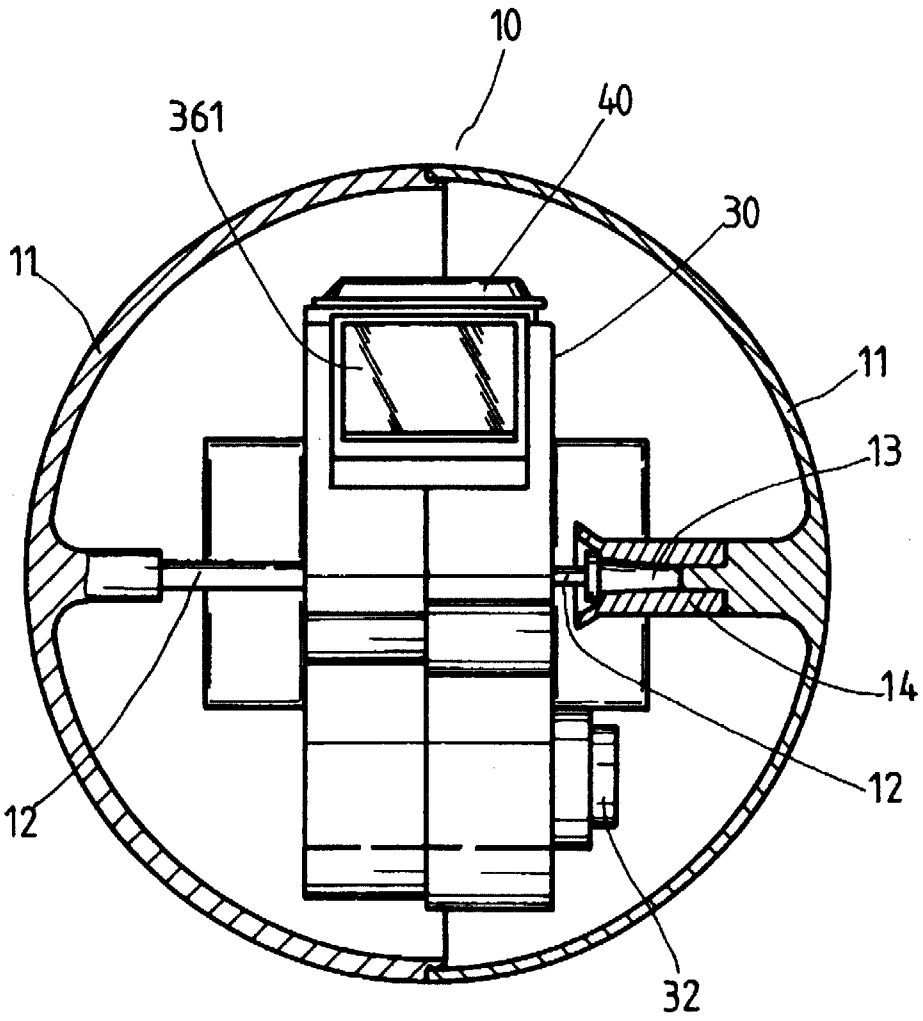
FIG. 3 is a side elevational view, partly in section, of the rolling toy in accordance with the present invention.
Figure 4:
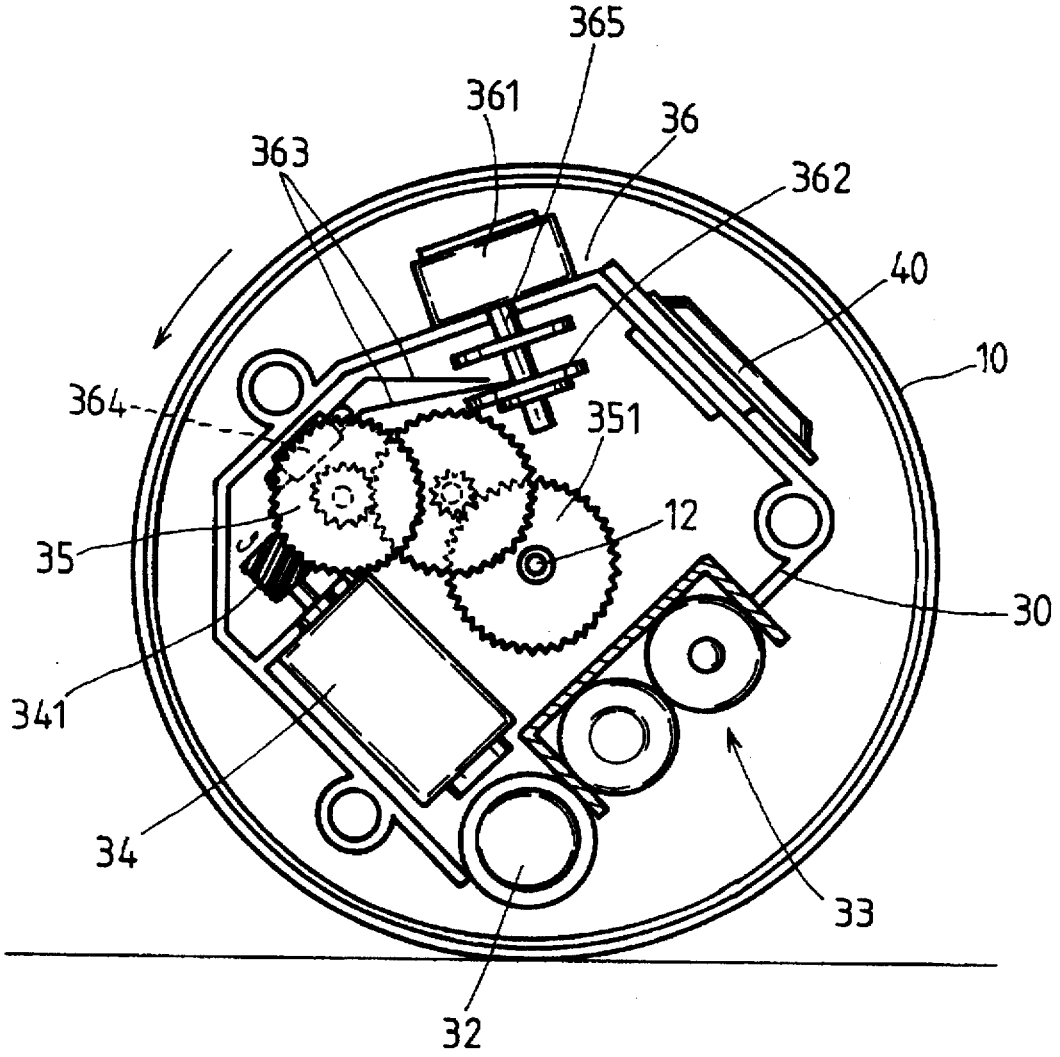
FIG. 4 is a side elevational view of an arrangement of the motor, the gear assembly, the weight and the magnetic switch disposed in one of the two parts of the sphere body.

Referring to the drawings and initially to FIGS. 1 through 4, a rolling toy in accordance with the present invention generally includes a rolling body, such as a sphere body 10, composed of two parts 11, one of the parts 11 has an axle 12 integrally and centrally extending from an inner surface thereof and the other part 11 has a receiving protrusion 14 extending from an inner surface thereof and the distal end of the axle 12 is mounted by a cap element 13 so as to be securely fixed into a recess defined in the receiving protrusion 14.

A frame 30 is is rotatably supported on axle 12 between parts 11 and has a motor 34 disposed thereon, the motor 34 being powered by a battery set 33 and has an output shaft which is a worm rack 341 mechanically connected to a reduction gear assembly 35 the latter including an end gear 351 fixedly mounted to the axle 12 of the sphere body 10. A magnetic switch assembly is provided in the frame 30 and includes a switch element 364 and a first magnetic element 361, the first magnetic element 361 being supported by the frame 30 and having a rod 365 extending therefrom which removably extends through the frame 30. The switch element 364 has two actuating plates 363 extending therefrom toward two disks 362 extending radially from the rod 365 of the first magnetic element 361.

A weight 32 is mounted to the frame 30 and is located in a position opposite to that of the first magnetic element 361 such that the first magnetic element 361 is always maintained in an upper position when the sphere body 10 is rolling because frame 30 is rotatably supported as axle 12.

A second magnetic element 21 is provided at an outer surface of the sphere body 10 and the second magnetic element 21 has a toy bear 20 connected thereto. The second magnetic element 21 is magnetically adhered to the sphere body 10 by the first magnetic element 361 so as to magnetically lift the first magnetic element 361 to contact the actuating plates 363 by the two disks 362 thus engaging the switch element 364 and actuating the motor 34.

Figure 5:
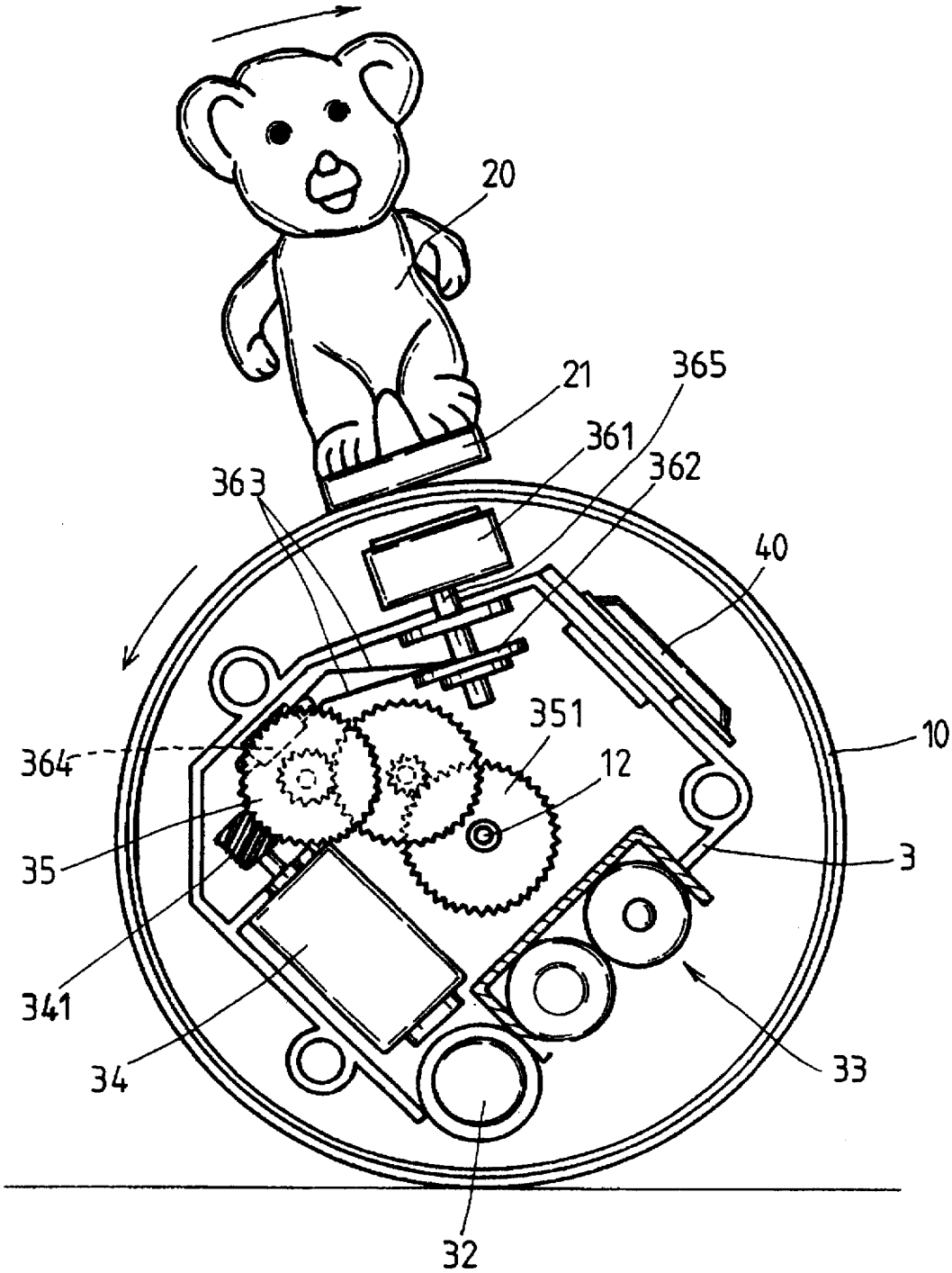
FIG. 5 is a side elevational view of an arrangement of the sphere body onto which a second magnetic element is magnetically adhered.

Referring to FIG. 5, when the motor 34 is actuated, the gear assembly 35 is operated and the axle 12 together with the sphere body 10 is rotated by the end gear 351. Because the weight 32 is located opposite to that of the first magnetic element 361, and frame 30 is rotatably supported on axle 12 the first magnetic element 361 is always located at an upper position of the sphere body 10 when the sphere body 10 is rolling. Therefore, the second magnetic element 21 and the toy bear 21 will maintain the upper position when the sphere body 10 is rolling. Furthermore, the frame 30 has a voice producing element 40 provided thereon that is actuated by the magnetic switch assembly so as to produce sound when the sphere body 10 is rolling.

Figure 6:
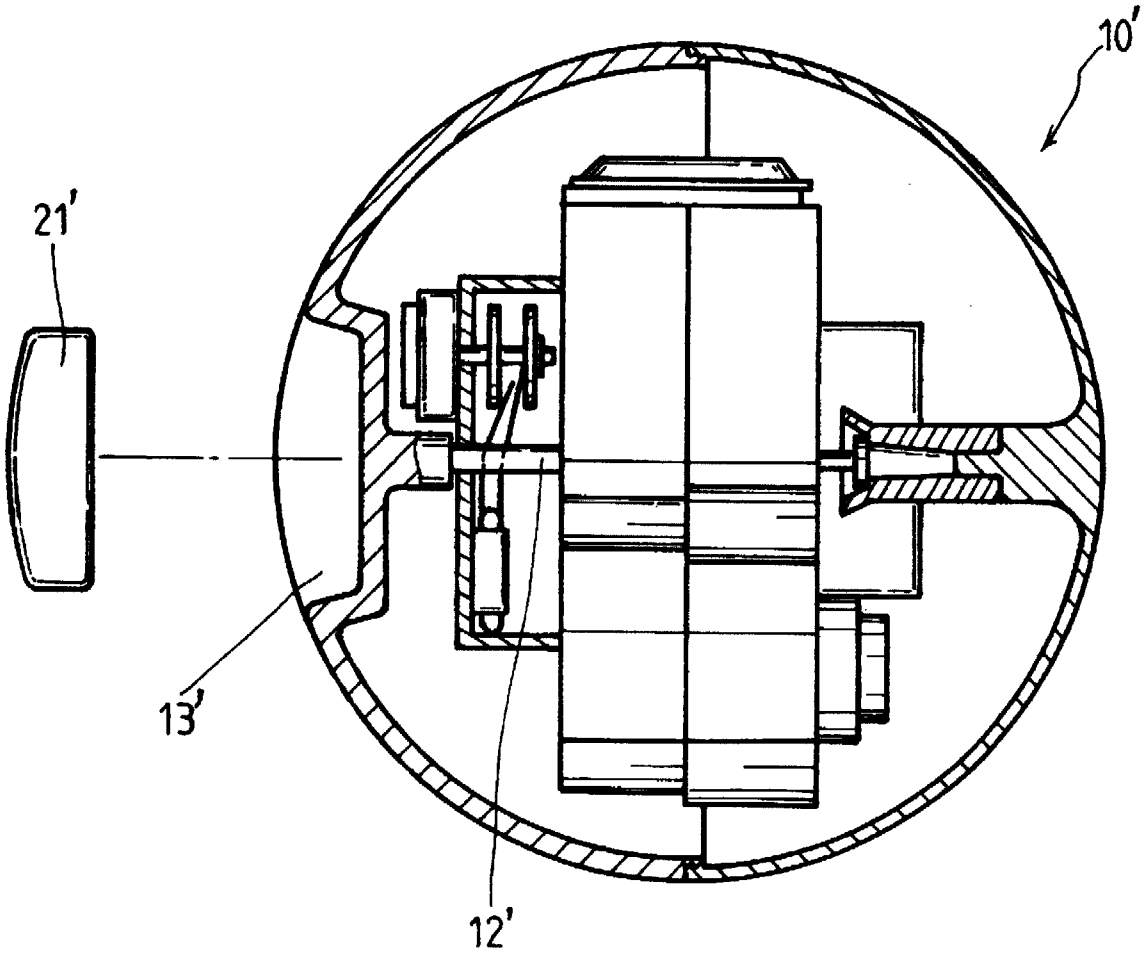
FIG. 6 is an exploded view of another embodiment of the rolling body wherein the sphere body has a recess defined in an outer peripheral surface thereof to receive a third magnetic element therein.
Figure 7:
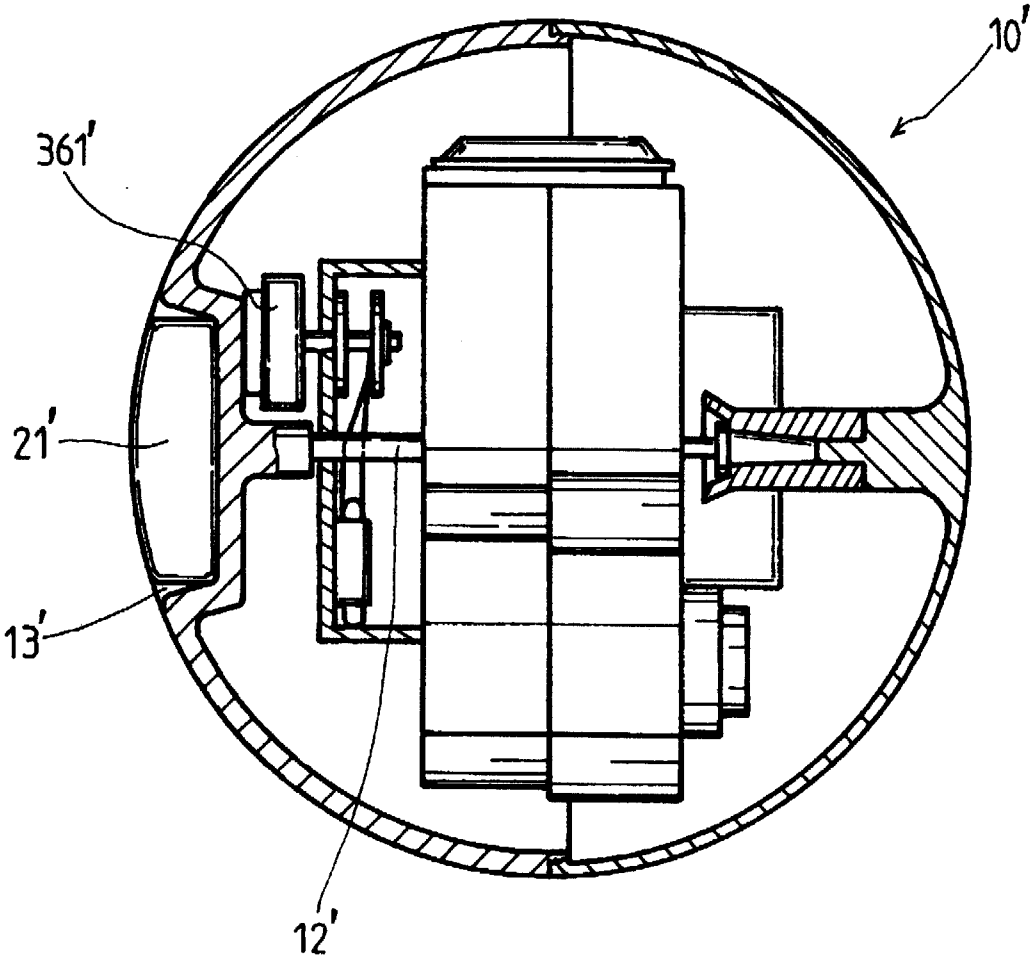
FIG. 7 is a cross sectional view of the assembled the embodiment of the rolling toy shown on FIG. 6.
Figure 8:
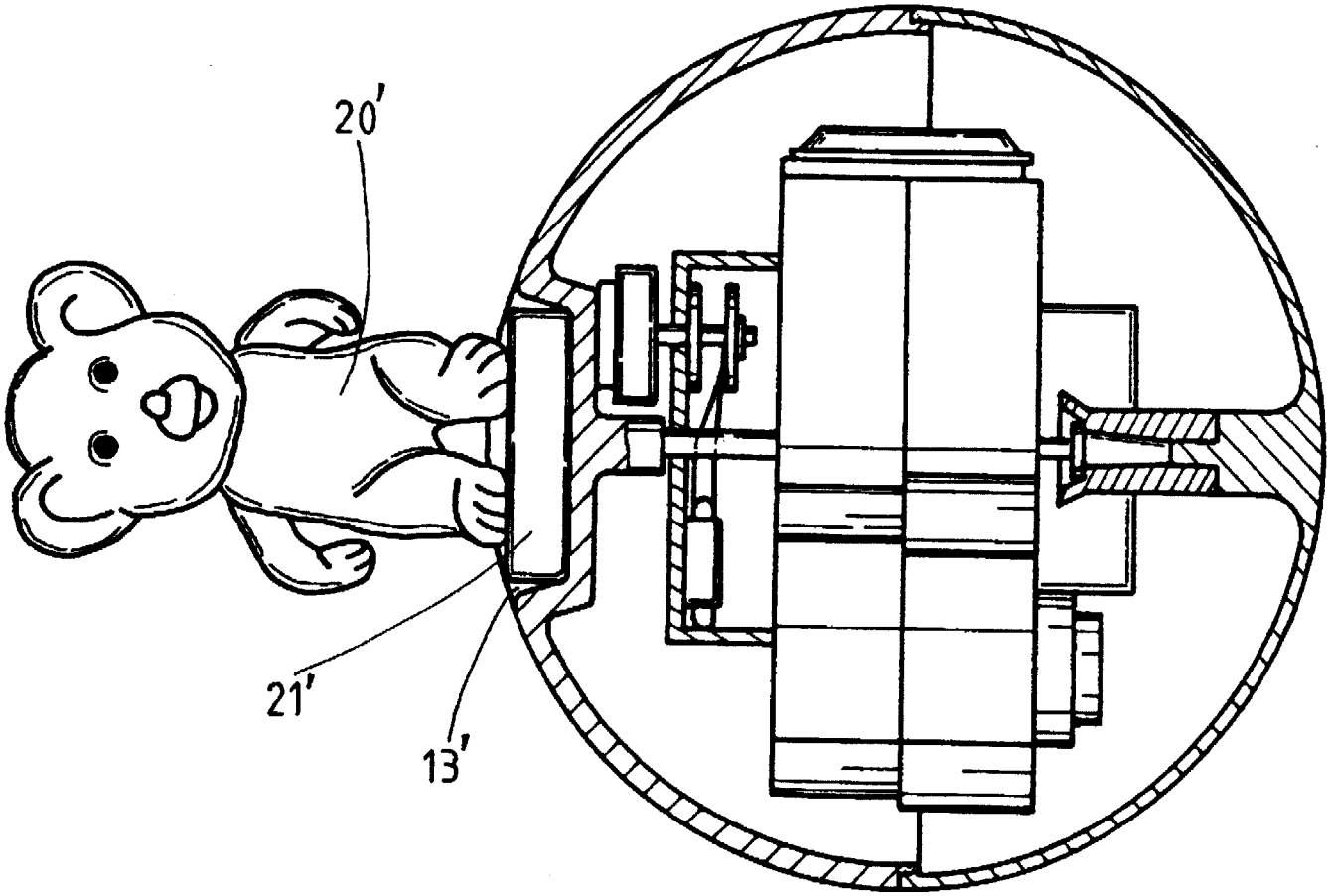
FIG. 8 is partial cross sectional view showing a second magnetic element magnetically adhered to the third magnetic element.

FIGS. 6 through 8 show an embodiment of the rolling toy wherein the sphere body 10' has a recess 13' defined in an outer surface thereof and the recess 13' is located to share the same axis of the axle 12'. A third magnetic element 21' is received in the recess 13' and is magnetically adhered by the first magnetic element 361'. The third magnetic element 21' magnetically adheres a toy bear 20' such that the toy bear 20' is always located at a lateral position when the sphere body 10' is rolling.

Accordingly, the rolling toy in accordance with the present invention can be operated by disposing the second magnetic element 21 onto the sphere body 10' without disengaging the sphere body 10.

Although the invention has been explained in relation to its preferred embodiments, it is to be understood that many other possible modifications and variations can be made without departing from the spirit and scope of the invention as hereinafter claimed.

What is claimed is:

1. A rolling toy comprising:

a rolling body composed of two parts, an axle connected between a pair of respective inner surfaces of said two parts;

a frame rotationally supported on the axle between said two parts and having a motor disposed thereto, said motor mechanically connected to a gear assembly which has an end gear fixedly mounted to said axle of said rolling body, a magnetic switch disposed to said frame and including a switch element and a first magnetic element, said first magnetic element supported by said frame and having a rod extending therefrom which removably extends through said frame and said switch element having at least one actuating plate extending therefrom toward said first magnetic element;

a weight provided on said frame and located at a position opposite to that of said first magnetic element for maintaining the first magnetic element at an upper position during rolling of the body, and a second magnetic element disposed on an outer surface of said rolling element for magnetically lifting said first magnetic element to contact said actuating plate and engage said switch element for actuating said motor.

2. The rolling toy as claimed in claim 1 wherein said frame further includes a voice producing element disposed thereon, the voice producing element being actuated by said magnetic switch.

3. The rolling toy as claimed in claim 1 wherein said motor further includes an output shaft and a worm rack, and said gear assembly is a reduction gear assembly which is engaged with said worm rack.

4. The rolling toy as claimed in claim 1 wherein said rod of said first magnetic element includes two disks extending radially therefrom and said switch element includes two actuating plates which extend between said two disks such that when said rod and said first magnetic element are magnetically lifted by said second magnetic element, said two actuating plates contact with each other to engage said switch element.

5. The rolling toy as claimed in claim 1 wherein said rolling body includes a recess formed in said outer surface for receiving said second magnetic element.

* * * * *